US010662572B2

(12) United States Patent
Kang et al.

(10) Patent No.: US 10,662,572 B2
(45) Date of Patent: May 26, 2020

(54) CLOTHES DRYER

(71) Applicant: SAMSUNG ELECTRONICS CO., LTD., Suwon-si, Gyeonggi-do (KR)

(72) Inventors: Geun Kang, Hwaseong-si (KR); Boo Keun Yoon, Yongin-si (KR); Myung-Won Jeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 111 days.

(21) Appl. No.: 15/655,056

(22) Filed: Jul. 20, 2017

(65) Prior Publication Data

US 2018/0023242 A1 Jan. 25, 2018

(30) Foreign Application Priority Data

Jul. 22, 2016 (KR) ..... 10-2016-0093381

(51) Int. Cl.

| | |
|---|---|
| ***D06F 58/00*** | (2020.01) |
| ***D06F 58/20*** | (2006.01) |
| ***D06F 58/26*** | (2006.01) |
| ***D06F 58/28*** | (2006.01) |
| *D06F 58/02* | (2006.01) |
| *D06F 58/10* | (2006.01) |
| *D06F 73/02* | (2006.01) |

(52) U.S. Cl.

CPC ..... *D06F 58/20* (2013.01); *D06F 58/26* (2013.01); *D06F 58/28* (2013.01); *D06F 58/02* (2013.01); *D06F 58/10* (2013.01); *D06F 73/02* (2013.01)

(58) Field of Classification Search

USPC ..... 34/109, 108, 127, 130–132

See application file for complete search history.

(56) References Cited

U.S. PATENT DOCUMENTS

| | | | |
|---|---|---|---|
| 2,799,948 | A | 7/1957 | Morrison |
| 2004/0250442 | A1 | 12/2004 | Ryu |

(Continued)

FOREIGN PATENT DOCUMENTS

| | | |
|---|---|---|
| EP | 1 975 306 | 10/2008 |
| KR | 10-2008-0020212 | 3/2008 |

(Continued)

OTHER PUBLICATIONS

Extended European Search Report dated May 28, 2019 from European Patent Application No. 17831375.5, 7 pages.

*Primary Examiner* — John P McCormack

(74) *Attorney, Agent, or Firm* — Staas & Halsey LLP

(57) ABSTRACT

A clothes dryer includes a main body, a first drying tub having a rotary drum provided rotatably inside the main body, and a second drying tub provided separately from the first drying tub inside the main body. A first supply flow path is provided to supply air to the first drying tub and a second supply flow path branches from the first supply flow path to supply air to the second drying tub. A first discharge flow path is provided to discharge air from the first drying tub, and a second discharge flow path is provided to discharge the air of the second drying tub through the first drying tub. The user can selectively apply a rotating method having a rapid drying speed and a non-rotating method capable of minimizing damage to clothes according to the characteristics of clothes.

24 Claims, 12 Drawing Sheets

(56) References Cited

U.S. PATENT DOCUMENTS

| | | | | |
|---|---|---|---|---|
| 2006/0137208 | A1* | 6/2006 | Lee | D06F 58/20 34/130 |
| 2008/0053166 | A1* | 3/2008 | Lim | D06F 29/005 68/5 C |
| 2011/0302799 | A1 | 12/2011 | Ahn et al. | |
| 2013/0298337 | A1 | 11/2013 | Doh et al. | |
| 2014/0298671 | A1 | 10/2014 | Lee et al. | |
| 2016/0160424 | A1* | 6/2016 | Kim | D06F 58/04 34/109 |

FOREIGN PATENT DOCUMENTS

| | | |
|---|---|---|
| KR | 20-0473784 | 7/2014 |
| KR | 10-2014-0107819 | 9/2014 |

* cited by examiner

CLOTHES DRYER

CROSS-REFERENCE TO RELATED APPLICATIONS

This application claims the priority benefit of Korean Patent Application No. 10-2016-0093381, filed on Jul. 22, 2016 in the Korean Intellectual Property Office, the disclosure of which is incorporated herein by reference in its entirety.

BACKGROUND

1. Field

Embodiments of the disclosure relate to a composite clothes dryer having a plurality of drying tubs.

2. Description of the Related Art

Generally, a clothes dryer is a device for drying clothing inside a drum by allowing hot air to pass through the drum while rotating the drum containing the clothes at a low speed.

The clothes dryer may include a drum rotatably installed therein for accommodating clothes therein, a driving device for driving the drum, a blower for blowing air into the rotating drum, a supply flow path for guiding air into the drum, and a discharge flow path for guiding air discharged from the drum.

When the clothes dryer is operated after putting the clothes into the drum, the drum is rotated by the operation of the driving device, and air is blown into the drum by the operation of the air blowing device. Therefore, the clothes accommodated in the drum can be dried at a high speed while repeating the operation of rising and falling by the rotation of the drum.

However, in such a rotary drum type clothes dryer, since the operation of raising and lowering the clothes is repeated by the rotating operation of the drum, the clothes may be damaged by the mechanical force acting on the clothes.

SUMMARY

Additional aspects and/or advantages will be set forth in part in the description which follows and, in part, will be apparent from the description, or may be learned by practice of the disclosure.

One aspect of the disclosure discloses a composite clothes dryer capable of selectively applying a rotation method in which a user can rapidly dry clothes and a non-rotation method in which damage to clothes is minimized, according to the characteristics of clothes.

In accordance with one aspect of the disclosure, a clothes dryer may include a main body, a first drying tub having a rotary drum provided rotatably inside the main body, a front support plate to support the rotary drum, and a rear support plate to support the rotary drum, a second drying tub provided inside the main body separately from the first drying tub, a first supply flow path provided to supply air to the first drying tub, a second supply flow path branched from the first supply flow path to supply air to the second drying tub, a first discharge flow path provided to discharge air from the first drying tub, and a second discharge flow path provided to discharge the air of the second drying tub through the first drying tub.

The clothes dryer may further include an outlet duct connecting the second drying tub and the front support plate to form the second discharge flow path.

The clothes dryer may further include a supply duct coupled to the rear support plate to form the first supply flow path and an inlet duct connecting the supply duct and the second drying tub to form the second supply flow path.

The clothes dryer may further include a shutter provided in at least one of the second supply flow path and the second discharge flow path so as to control supply of air to the second drying tub.

The clothes dryer may further include a heater to heat the air supplied to the first drying tub and the second drying tub.

The clothes dryer may further include a blowing fan to blow air to the first drying tub and the second drying tub.

The clothes dryer may further include a filter arranged to filter the foreign matter from the air discharged from the first drying tub and the second drying tub.

The second drying tub may be arranged above the first drying tub.

The first drying tub may include a first entrance formed on a front face of the first drying tub and the second drying tub may include a second entrance formed on an upper face of the second drying tub.

The clothes dryer may further include a first door that opens and closes the first entrance, and a second door that opens and closes the second entrance.

The clothes dryer may further include a plurality of racks provided in multiple layers to support the clothes in the second drying tub.

The plurality of racks may be configured to be unfolded upward when the second door is opened.

The plurality of racks may be configured to be popped up upward when the second door is pushed.

The second door may be rotatably coupled to the body, and the plurality of racks may include a first rack and a second rack arranged below the first rack, and when the second door is opened, the plurality of racks are unfolded upward such that the gap between the front end of the first rack and the front end of the second rack is larger than the gap between the rear end of the first rack and the rear end of the second rack.

In accordance with another aspect of the disclosure, a clothes dryer may include a main body, a drying tub provided inside the main body and having an entrance formed on an upper face of the drying tub, a plurality of racks provided in a multiple layers to support the clothes in the drying tub, and a door that opens and closes the entrance, and the plurality of racks are configured to be unfolded upward when the door is opened.

When the door is pushed, the door and the plurality of racks are popped up upward.

The clothes dryer may further include a plurality of link members to connect the plurality of racks to each other and an elastic member to elastically support the plurality of link members so as to pop up the plurality of racks upward.

The plurality of racks may include a first rack and a second rack arranged below the first rack, and when the door is opened, the plurality of racks are unfolded upward such that the gap between the front end of the first rack and the front end of the second rack is larger than the gap between the rear end of the first rack and the rear end of the second rack.

The clothes dryer may further include a link member connecting the front end portion of the first rack and the rear end portion of the second rack.

The rack may include a stopper protrusion to limit an angular range between the link member and the rack.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
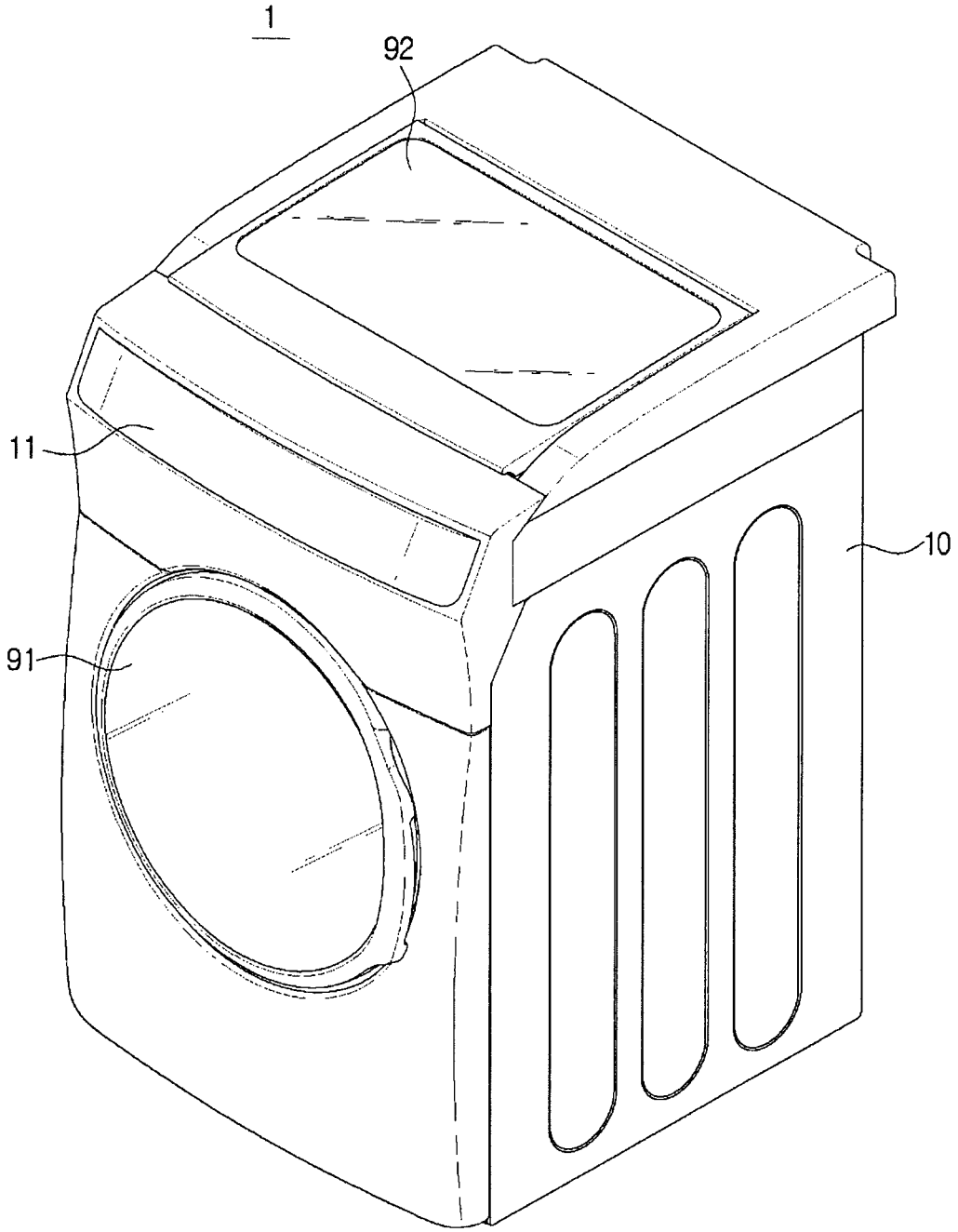
FIG. 1 is a view showing an outer appearance of a clothes dryer according to an embodiment of the disclosure.

The embodiments described herein are merely preferred embodiments of the disclosure and are not intended to represent all of the technical ideas of the disclosure, so it should be understood that various equivalents or modifications that may be substituted for the same at the time of filing of the application are also included in the scope of the disclosure.

Reference will now be made in detail to the embodiments of the disclosure, examples of which are illustrated in the accompanying drawings, wherein like reference numerals refer to like elements throughout.

Figure 2:
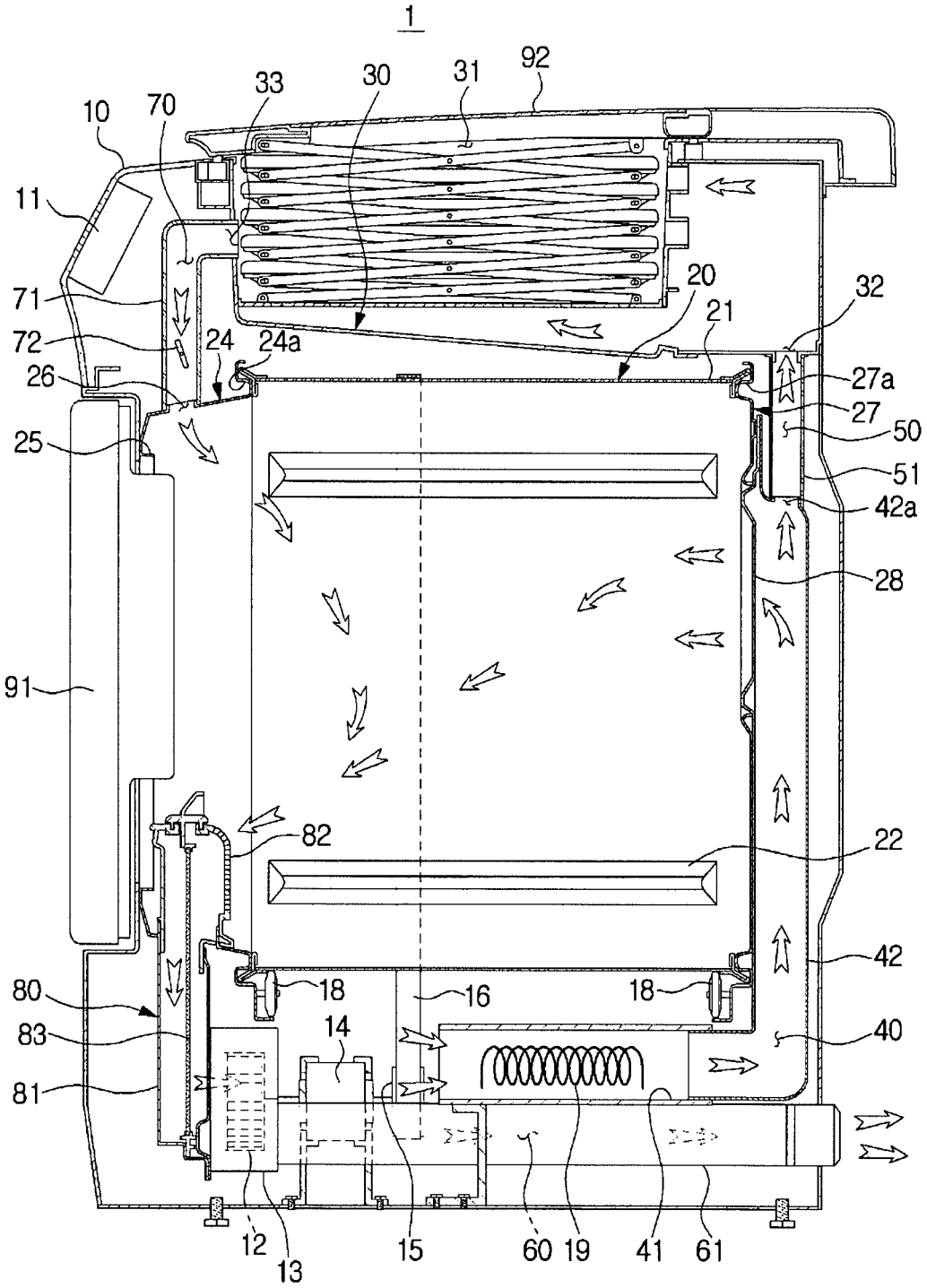
FIG. 2 is a side cross-sectional view schematically showing a main configuration of the clothes dryer of FIG. 1.
Figure 3:
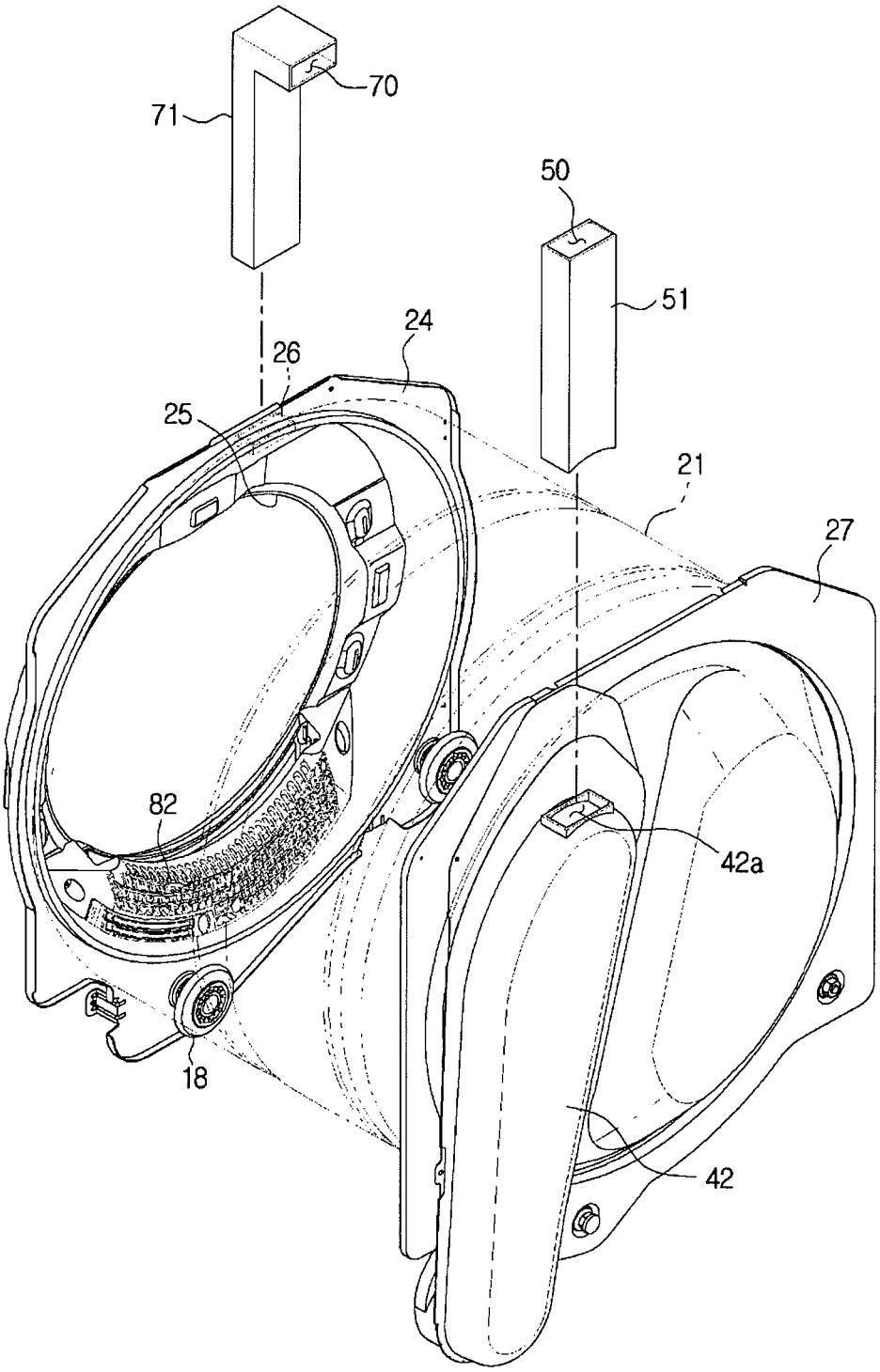
FIG. 3 is a view showing an inlet duct and an outlet duct of the clothes dryer of FIG. 1.

FIG. 1 is a view showing an outer appearance of a clothes dryer according to an embodiment of the disclosure. FIG. 2 is a side cross-sectional view schematically showing a main configuration of the clothes dryer of FIG. 1. FIG. 3 is a view showing an inlet duct and an outlet duct of the clothes dryer of FIG. 1.

A clothes dryer 1 according to an embodiment of the disclosure may include a main body 10 forming an exterior appearance, a first drying tub 20 and a second drying tub 30 which are provided inside the main body 10 and accommodate clothes, a blowing fan 12 for blowing air to the first drying tub 20 and the second drying tub 30 and a heater 19 for heating the air supplied to the first drying tub 20 and the second drying tub 30.

The main body 10 may have a substantially box shape and a first door 91 may be provided on the front face of the main body 10 to open and close a first entrance 25 of the first drying tub 20. A first door 91 may be rotatably coupled to the main body 10. A second door 92 for opening and closing a second entrance 31 of the second drying tub 30 may be provided on the upper face of the main body 10. A control panel 11 for displaying variety of information on the clothes dryer 1 or inputting an operation command may be provided on the front of the main body 10.

The first drying tub 20 may dry the clothes in a rotating manner. The first drying tub 20 may include a rotary drum 21 having a cylindrical shape with front and rear openings and being rotatable and a front support plate 24 and a rear support plate 27 for supporting the rotary drum 21.

The front support plate 24 may include a front support portion **24*a* for supporting the front end portion of the rotary drum 21, the first entrance 25 through which clothes can be introduced into the first drying tub 20, and a connection opening 26 through which the air of the second drying tub 30** flows.

The rear support plate 27 may have a rear support portion **27*a* for supporting a rear end portion of the rotary drum 21 and a suction port 28 for introducing outside air into the first drying tub 20**.

A roller 18 for supporting the rotary drum 21 to rotate smoothly may be provided at under the rotary drum 21. On the inner circumferential surface of the rotary drum 21, a lifter 22 for lifting the clothes may be provided.

The clothes dryer 1 may include a driving motor 14 that generates a driving force for rotating the rotary drum 21 and operating the blowing fan 12. The blowing fan 12 may be connected to one end of a rotating shaft of the driving motor 14 and a pulley 15 may be connected to the other end of the rotating shaft. The outer surface of the pulley 15 and the outer surface of the rotary drum 21 may be connected by a belt 16 so that the driving force of the driving motor 14 may be transmitted to the rotary drum 21.

The second drying tub 30 may be provided above the first drying tub 20. The second drying tub 30 may dry clothes in a non-rotating manner. That is, the second drying tub 30 may be maintained in a fixed state without rotating.

The size of the second drying tub 30 may be smaller than that of the first drying tub 20. Therefore, the amount of clothes accommodated in the second drying tub 30 may be smaller than the amount of clothes accommodated in the first drying tub 20.

The second drying tub 30 has the second entrance 31 through which clothes can be put into the inside thereof and the second entrance 31 may be formed on the upper face of the second drying tub 30. The second drying tub 30 may have an inlet 32 through which the outside air flows and an outlet 33 through which the air in the second drying tub 30 is discharged to the outside. At least one rack 100 (FIG. 4) may be provided in the second drying tub 30 to support the clothes.

The clothes dryer 1 may include a first supply flow path 40 provided to supply air to the first drying tub 20 and a second supply flow path 50 branched from the first supply flow path 40 to supply air to the second drying tub 30, a first discharge flow path 60 for discharging the air in the first drying tub 20 and a second discharge path 70 for discharging the air in the second drying tub 30 through the first drying tub 20.

The first supply flow path 40 may be formed by supply ducts 41 and 42. The supply ducts 41 and 42 may include a lower supply duct 41 formed in a lower side of the first drying tub 20 and a rear supply duct 42 having one end coupled to the lower supply duct 41 and the other end coupled to the suction port 28 of the first drying tub 20. The first supply flow path 40 may be provided with the heater 19 to heat the air flowing in the first supply flow path 40.

The second supply flow path 50 may be formed by an inlet duct 51. The inlet duct 51 may connect a branch hole 42*a* of the supply duct 42 and the inlet 32 of the second drying tub 30. In the embodiment, the inlet duct 51 and the supply duct 42 are provided separately, but it goes without saying that the inlet duct 51 and the supply duct 42 may be integrally formed.

The first discharge flow path 60 may be formed by a filter case 81, a blowing fan case 13, and a discharge duct 61.

The second discharge flow path 70 may be formed by an outlet duct 71. The outlet duct 71 may connect the outlet 33 of the second drying tub 30 to the connection opening 26 of the front support plate 24.

With this configuration, when the drive motor 14 is operated, the driving force generated by the drive motor 14 is transmitted to the rotary drum 21 via the pulley 15 and the belt 16, whereby the rotary drum 21 rotates.

Further, the driving force generated by the driving motor 14 rotates the air blowing fan 12 to generate air flow. Therefore, the outside air is supplied to the first drying tub 20 and the second drying tub 30 through the first supply flow path 40 and the second supply flow path 50, respectively. In the first drying tub 20, the clothes are dried and the moistened air is discharged through the first discharge flow path 60 and the clothes are dried in the second drying tub 30 and the humidified air is passed through the second discharge flow path 70 to the first drying tub 20 and then discharged through the first discharge flow path 60.

A filter 80 may be mounted in a lower side of the front support plate 24 to filter out foreign matter from the air discharged through the first discharge flow path 60. The filter 80 may include a filter case 81, a grill 82 formed on one side of the filter case 81, and a filter member 83 provided inside the filter case 81.

Unlike the above case, when the driving motor 12 is operated, air may be supplied only to the first drying tub 30 without supplying air to the second drying tub 30. For this purpose, a shutter 72 may be provided in the second discharge flow path 70 for guiding the air in the second drying tub 30 to the first drying tub 20.

That is, when it is desired to perform drying using both the first drying tub 20 and the second drying tub 30, the first drying tub 20 and the second drying tub 30 are opened by opening the shutter 72, and in the case where only the first drying tub 20 is to be used without using the second drying tub 30, the shutter 72 may be closed to prevent air from flowing into the second drying tub 30.

In this embodiment, the shutter 72 is provided in the second discharge flow path 70. Alternatively, the shutter 72 may be provided in the second supply flow path 50 to perform the same function.

As described above, in the clothes dryer 1 according to the embodiment of the disclosure, the first drying tub 20 of the rotating type and the second drying tub 30 of the non-rotating type are provided together inside the main body 10, therefore the user can select either rotary drying or non-rotating drying depending on the characteristics of the clothes.

In addition, since hot air can be supplied to both the first drying tub 20 and the second drying tub 30 by one heater 19 and one blowing fan 12, the internal structure is simple and effective drying space is increased.

Since the air in the second drying tub 30 is not directly discharged but is discharged through the first drying tub 20, the flow path structure is simple and the air that has passed through the second drying tub 30 having a relatively small load can be recycled without being immediately discharged so that the drying efficiency can be increased.

Figure 4:
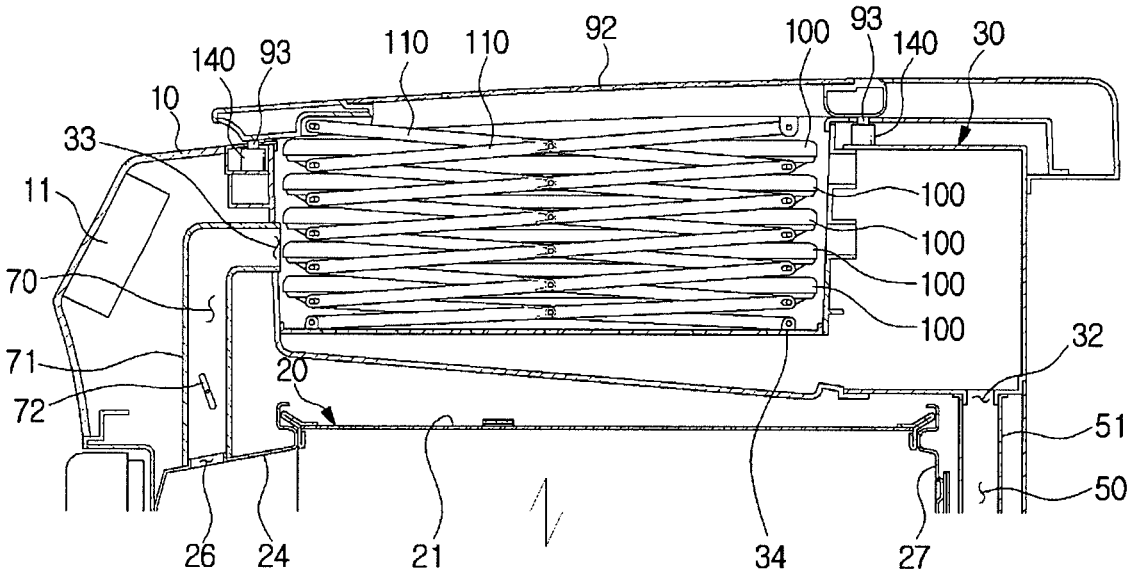
FIG. 4 is a side cross-sectional view of a second drying tub and a rack of the clothes dryer of FIG. 1.
Figure 5:
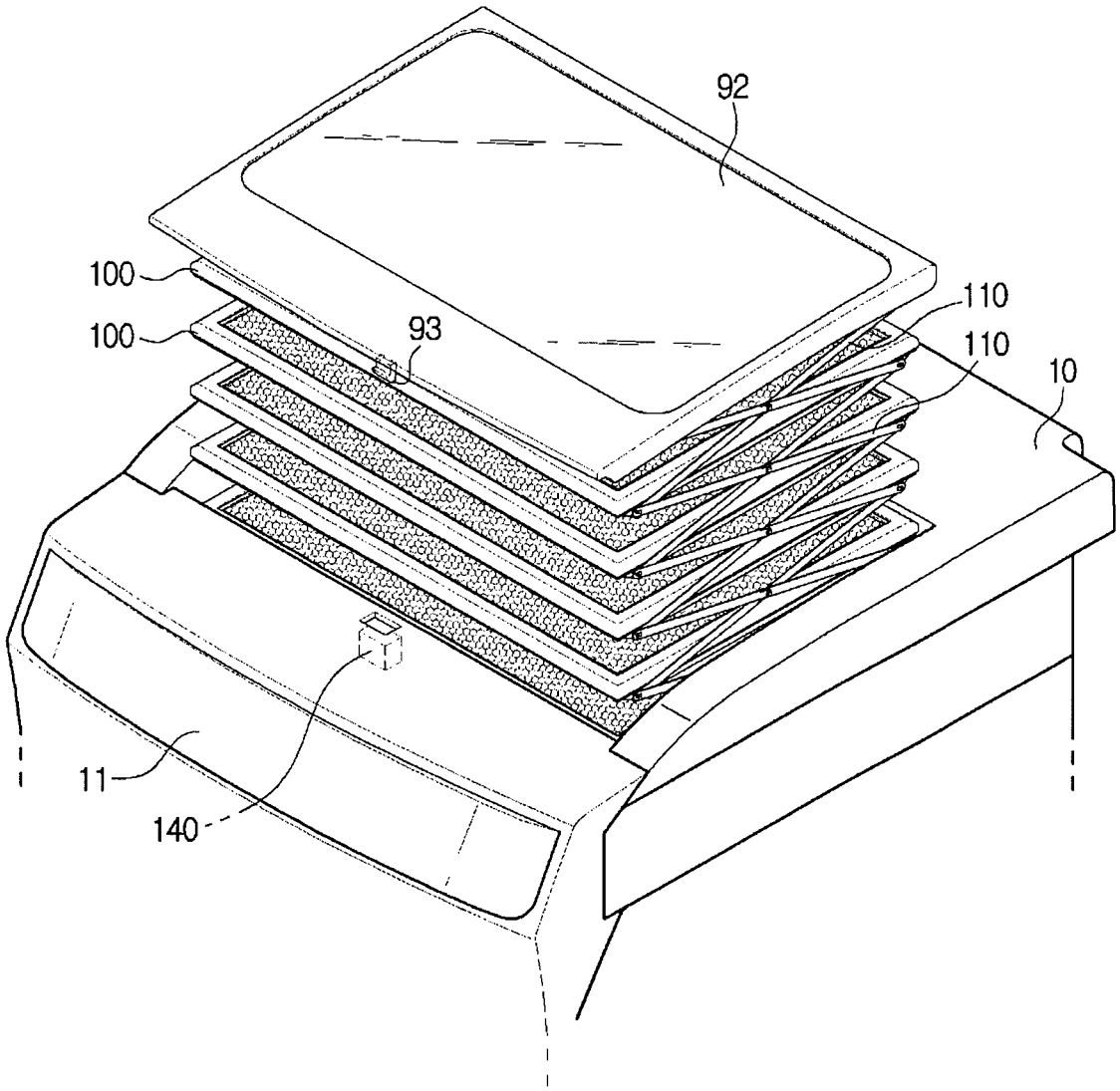
FIG. 5 is a view showing a state in which a second door and the rack of the clothes dryer of FIG. 1 are popped up.
Figure 6:
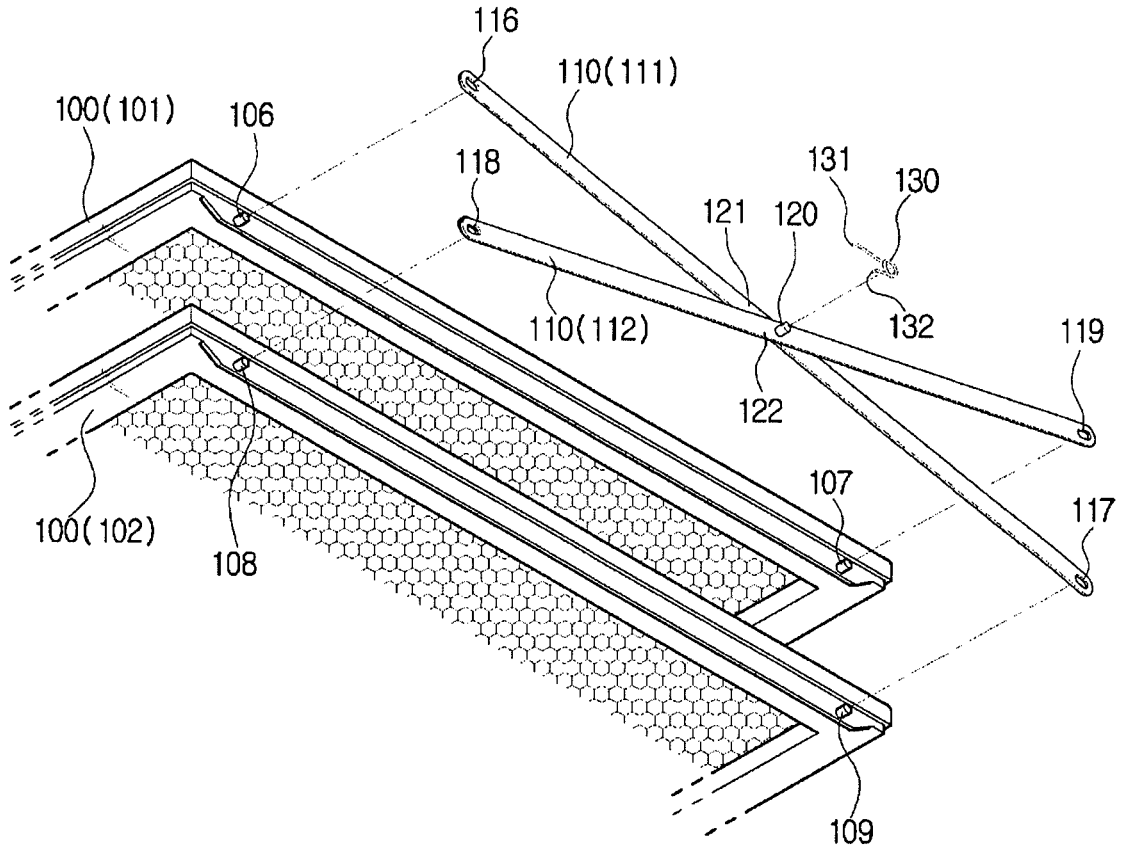
FIG. 6 is a view showing the rack and a link member of the clothes dryer of FIG. 1.
Figure 7:
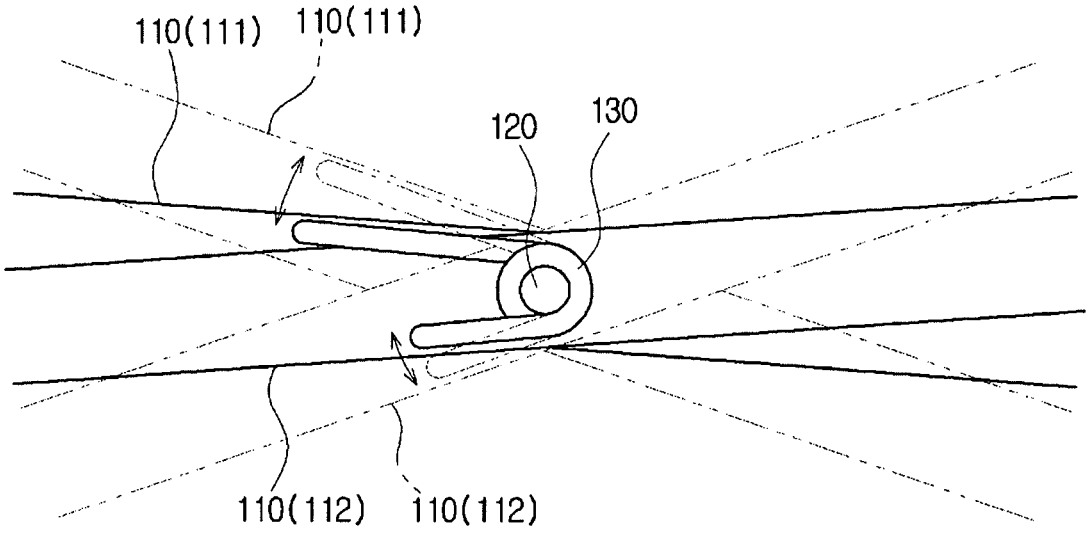
FIG. 7 is a view showing an operation of an elastic member popping up the rack of the clothes dryer of FIG. 1.

FIG. 4 is a side cross-sectional view of a second drying tub and rack of the clothes dryer of FIG. 1. FIG. 5 is a view showing a state in which a second door and the rack of the clothes dryer of FIG. 1 are popped up. FIG. 6 is a view showing the rack and a link member of the clothes dryer of FIG. 1. FIG. 7 is a view showing an operation of an elastic member popping up the rack of the clothes dryer of FIG. 1.

Referring to FIGS. 4 to 7, a rack of the clothes dryer according to an embodiment of the disclosure will be described.

The clothes dryer 1 according to an embodiment of the disclosure has the first drying tub 20 for performing drying in a rotating manner and the second drying tub 30 for performing drying in a non-rotating manner. The second drying tub 30 is provided above the first drying tub 20 and the second entrance 31 of the second drying tub 30 is formed on the upper side of the second drying tub 30.

A plurality of racks 100 may be provided in the vertical direction in multiple layers so as to support the clothes in the second drying tub 30. Further, when the second door 92 is pushed, the second door 92 and the plurality of racks 100 may be unfolded upward.

That is, when the second door 92 is pushed, the second door 92 and the plurality of racks 100 move upward, and at the same time, a space between adjacent racks 100 may be widened to facilitate placing the clothes on the rack 100.

The uppermost rack among the plurality of racks 100 is coupled to the second door 92 via the link member 110, the lowermost rack 100 is coupled to the rack support 34 of the second drying tub 30 via the link member 110, and the racks 100 between the uppermost rack 100 and the lowermost rack 100 are coupled to each other via the link member 110.

A locking protrusion 93 is formed on the second door 92 and a locking device 140 for locking the second door 92 by interacting with the locking protrusion 93 may be provided on the main body 10. The locking device 140 is configured to be unlocked by pushing the second door 92 with a predetermined force or more, and may be implemented in various known ways.

As shown in FIG. 6, any one of the plurality of racks 100 is referred to as a first rack 101, a rack adjacent to the bottom of the first rack 101 is referred to as a second rack 102, and a plurality of link members for connecting the first rack 101 and the second rack 102 is referred to as a first link member 111 and a second link member 112, respectively.

Connection pins 106 and 107 may be formed at the front and rear ends of the first rack 101 and connection pins 108 and 109 may be formed at the front and rear ends of the second rack 102, respectively.

The first link member 111 may be formed with a connection groove 116 to be coupled to the connection pin 106 and a connection groove 117 to be coupled to the connection pin 109. The first link member 111 may connect the front end of the first rack 101 and the rear end of the second rack 102.

The second link member 112 may be formed with a connection groove 118 to be coupled to the connection pin 108 and a connection groove 119 to be coupled to the connection pin 107. The second link member 112 may connect the rear end of the first rack 101 to the front end of the second rack 102.

Accordingly, the first link member 111 and the second link member 112 are crossed in an X-shape and may be rotatably coupled to each other about a rotation axis 120.

An elastic member 130 may be mounted on the rotating shaft 120. One end 131 of the elastic member 130 is coupled to a first elastic member support 121 formed on the first link member 111 and the other end 132 of the elastic member 130 is coupled to a second elastic member support 122 formed on the second link member 112.

As show in FIG. 7, the first link member 111 and the second link member 112 are movable between an unfolded position (dotted line) and a retracted position (solid line), and the elastic member 120 elastically supports the first link member 111 and the second link member 112 to move to the unfolded position.

The first link member 111 and the second link member 112 are urged by the elastic force of the elastic member 120 when the lock device 140 is unlocked by pushing the second door 92 with a predetermined force, so that the second door 92 and the racks 100 may be unfolded upwardly.

Figure 8:
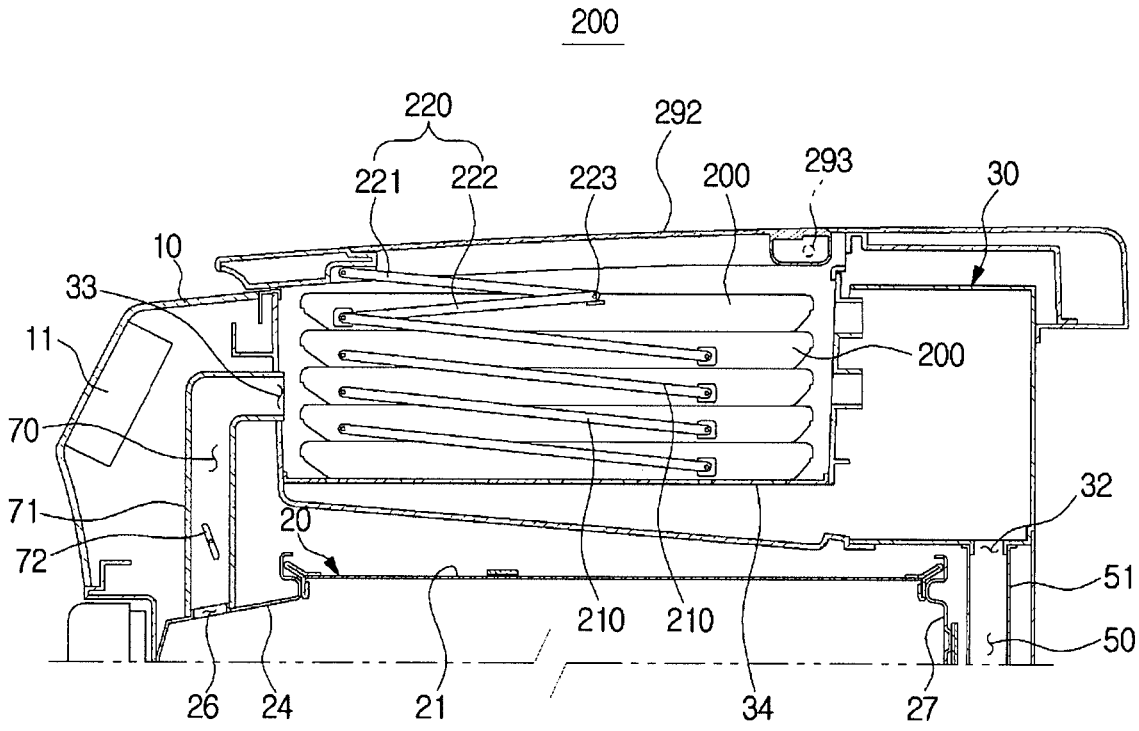
FIG. 8 is a side cross-sectional view showing a second drying tub and a rack of clothes dryer according to another embodiment of the disclosure.
Figure 9:
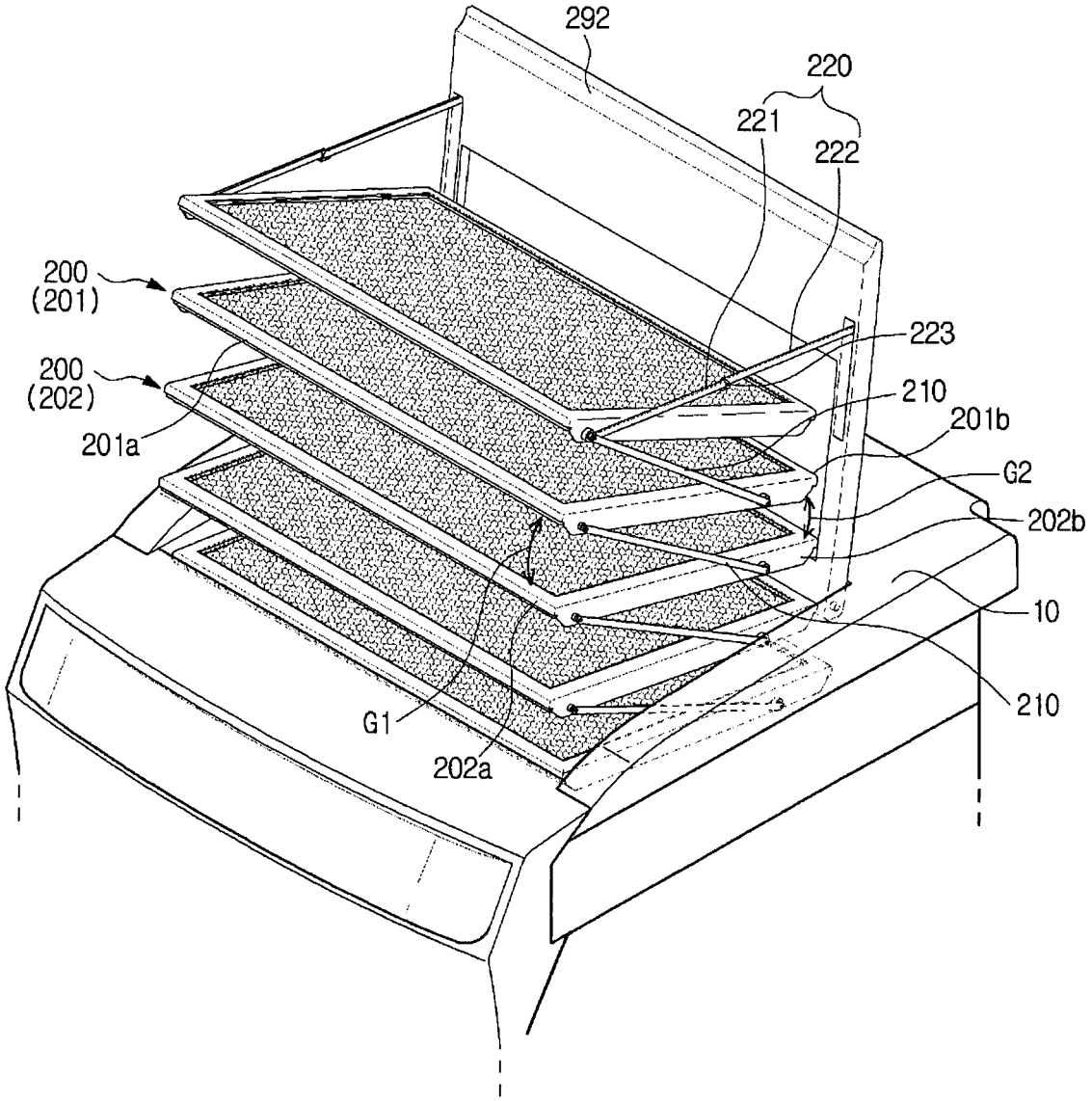
FIG. 9 is a view showing an operation of spreading the rack upward when the second door of the clothes dryer of FIG. 8 is opened.
Figure 10:
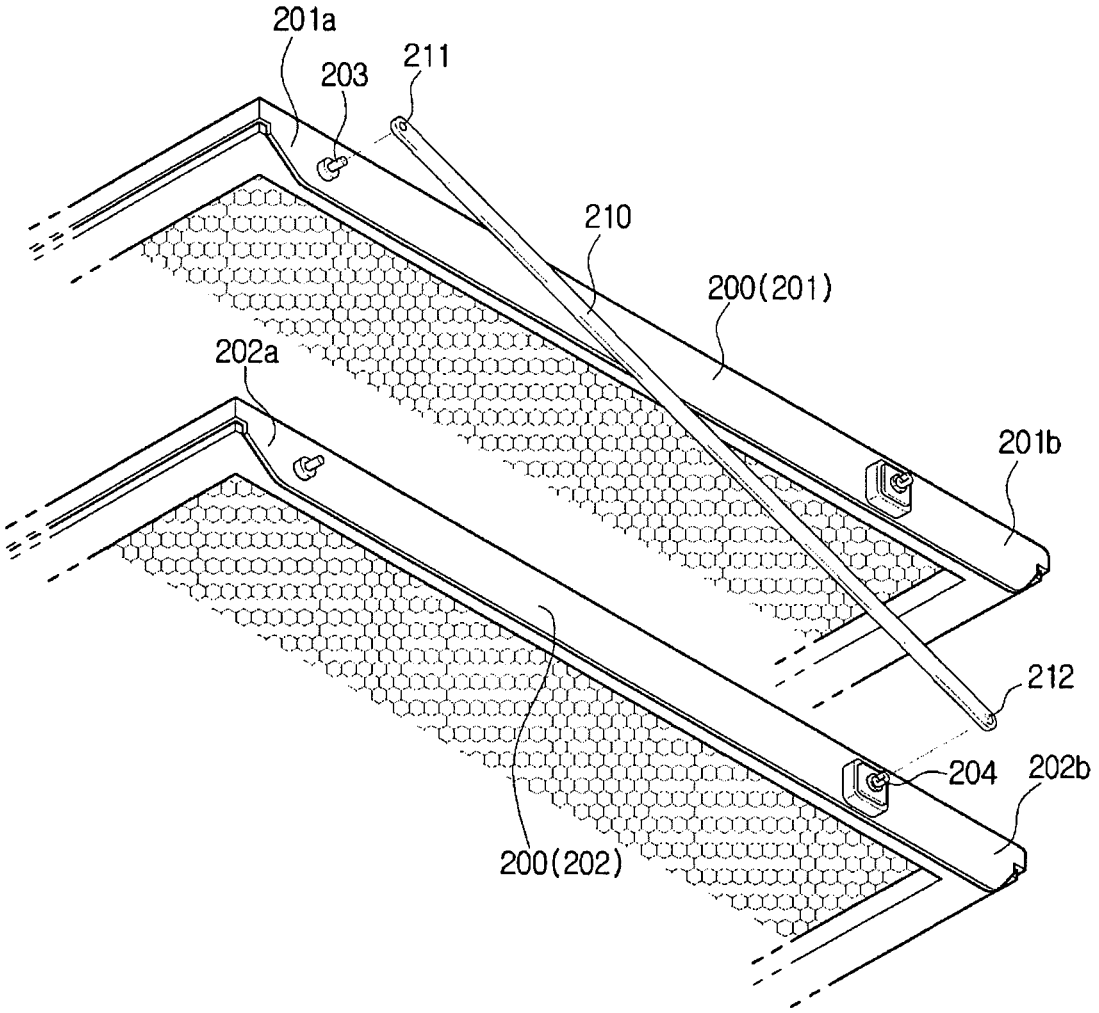
FIG. 10 is a view showing a rack and a link member of the clothes dryer of FIG. 8.
Figure 11:
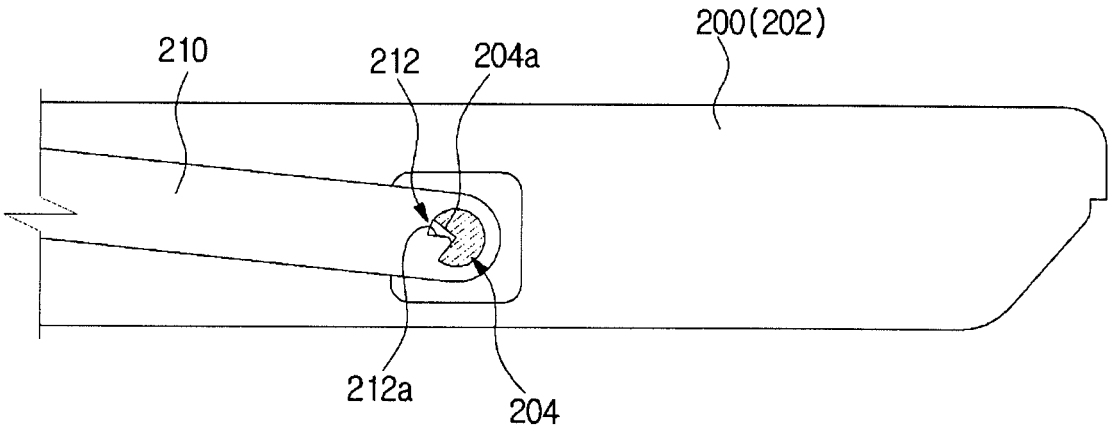
FIGS. 11 and 12 are views showing a function of a stopper protrusion of the clothes dryer of FIG. 8.
Figure 12:
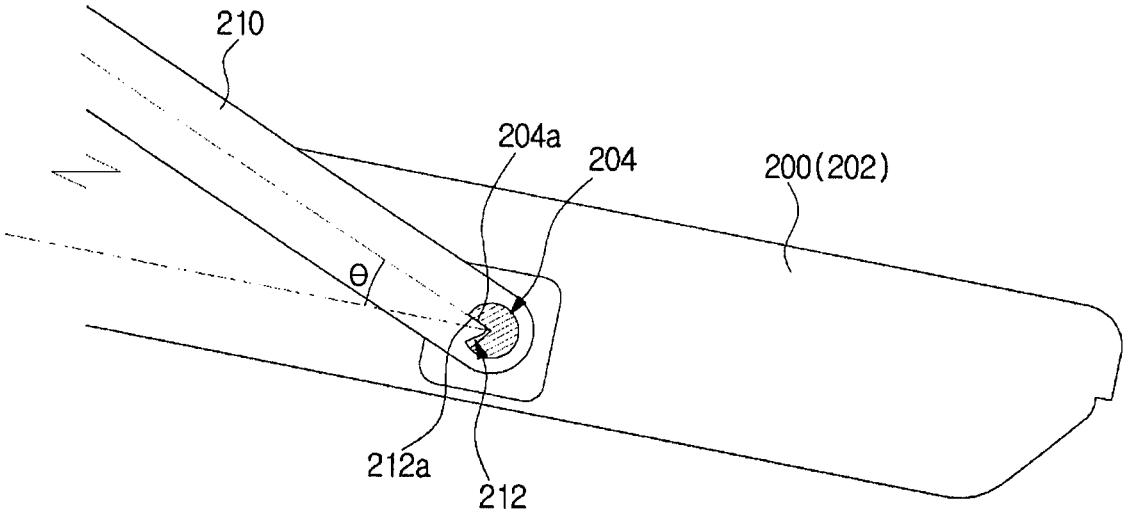

FIG. 8 is a side cross-sectional view showing a second drying tub and a rack of clothes dryer according to another embodiment of the disclosure. FIG. 9 is a view showing an operation of spreading the rack upward when the second door of the clothes dryer of FIG. 8 is opened. FIG. 10 is a view showing a rack and a link member of the clothes dryer of FIG. 8. FIGS. 11 and 12 are views showing a function of a stopper protrusion of the clothes dryer of FIG. 8.

Referring to FIGS. 8 to 12, a second drying tub and rack of a clothes dryer according to another embodiment of the disclosure will be described.

A second door 292 may be hinged to a main body 10, unlike the above-described embodiment. The second door 292 may be coupled to the main body 10 so as to be rotatable about a rotation shaft 293.

A rack 200 may include a first rack 201 and a second rack 202 provided below the first rack 201. When the door 292 is opened, the first rack 201 and the second rack 202 move upward so that a gap G1 between a front end 201*a* of the first rack 201 and a front end 202*a* of the second rack 202 may be larger than a gap G2 between a rear end 201*b* of the first rack 201 and a rear end 202*b* of the second rack 202.

The front end of the uppermost rack among the plurality of racks 200 is connected to the door 292 by a connecting member 220. The connecting member 220 may include a front connecting member 221 and a rear connecting member 222 that are rotatably coupled to each other about a joint 223.

The first rack 201 and the second rack 202 may be coupled by a link member 210. The link member 210 may connect the front end portion of the first rack 201 and the rear end portion of the second rack 202.

A link pin 203 is formed at the front end of the first rack 201 and a stopper protrusion 204 is formed at the rear end of the second rack 202. The link member 210 may have a connection hole 211 into which the connection pin 203 is inserted and a support groove 212 into which the stopper protrusion 204 is inserted. The connection pin 203 may freely rotate in the connection hole 211.

The stopper protrusion 204 and the support groove 212 serve to limit the angular range of the link member 210 and the rack 202. The stopper protrusion 204 is rotatably inserted into the support groove 212. When the stopper protrusion 204 is rotated at a predetermined angle or more with respect to the support groove 212, the stopper protrusion 204 may no longer rotate relative to the support groove 212.

That is, the stopper protrusion 204 has a stopper surface 204*a*, and the support groove 212 has a support surface 212*a* interfering with the stopper surface 204*a*.

The operation of the rack and the link member having such a configuration will be described. The front end of the uppermost rack 200 in the plurality of racks 200 is moved upward by the connecting member 220 when the door 292 rotatably coupled to the main body 10 is rotated and opened.

Next, the operation between the first rack 201 and the second rack 202 which are adjacent to each other will be described.

As shown in FIGS. 11 and 12, when the first rack 201 is raised, the front end portion of the link member 210 is raised. Therefore, the link member 210 rotates about the stopper protrusion 204 of the second rack 202 in the clockwise direction in the drawing relative to the second rack 202.

The support surface 212*a* of the support groove 212 of the link member 210 is brought into contact with the stopper surface 204*a* of the stopper protrusion 204 of the second rack 202 when the link member 210 continues to rotate. It is assumed that 0 is the angle between the link member 210 and the second rack 202 at this time.

When the angle between the link member 210 and the second rack 202 becomes 0, the link member 210 may no longer rotate relative to the second rack 202. When the link member 210 rotates, the second rack 202 rotates together. That is, 0 is the maximum angle between the link member 210 and the second rack 202.

Therefore, by appropriately designing the maximum angle θ between each rack 200 and the link member 210, the gap between the front end of the first rack and the front end of the second rack may be larger than the gap between the rear end of the first rack and the rear end of the second rack when the first rack and the second rack are spread upward.

Generally, when the clothes are placed on the rack, the clothes are placed as the clothes are moved from the front to the rear of the rack. Therefore it becomes easier to put the clothes on the rack when the gap of the front ends of the racks is larger than the gap of the rear ends.

According to one or more of the embodiments of the disclosure, the user can selectively apply the rotation method that can quickly dry the clothes and the non-rotation method that minimizes the damage to the clothes according to the characteristics of the clothes.

According to one or more of the embodiments of the disclosure, the clothes dryer can supply hot air to a plurality of drying tubs by one heater and one blowing fan. Accordingly, the internal structure of the clothes dryer can be simplified, the effective drying space can be expanded, and the cost can be reduced.

According to one or more of the embodiments of the disclosure, the air in the non-rotating dryer can be discharged through the rotary dryer. Therefore, the flow path structure is simplified, and the air supplied to the non-rotating type dryer is recycled, so that the drying efficiency can be increased.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A clothes dryer, comprising:

a main body;

a first drying tub including a rotary drum provided rotatably inside the main body;

a second drying tub provided separately from the first drying tub inside the main body, the second drying tub having an entrance with a door configured to open and close the entrance, and having a plurality of racks which extend through the entrance when the entrance is open;

a first supply flow path provided to supply air to the first drying tub;

a second supply flow path branched from the first supply flow path to supply air to the second drying tub;

a first discharge flow path provided to discharge air supplied to the first drying tub out of the first drying tub; and a second discharge flow path configured to discharge humidified air from the second drying tub to the first drying tub.

2. The clothes dryer according to claim 1, further comprising an outlet duct to connect the first drying tub with the second drying tub, wherein the first drying tub includes a front support plate to support the rotary drum, and the outlet duct is connected with the second drying tub and the front support plate to form the second discharge flow path.

3. The clothes dryer according to claim 1, further comprising:

a supply duct through which air is supplied to the first drying tub to form the first supply flow path; and an inlet duct, connecting the supply duct with the second drying tub, through which air is supplied to the second drying tub to form the second supply flow path, wherein the first drying tub includes a rear support plate to support the rotary drum, and the supply duct is coupled to the rear support plate.

4. The clothes dryer according to claim 1, further comprising:

a shutter provided in at least one of the second supply flow path and the second discharge flow path so as to control a flow of air into the second drying tub.

5. The clothes dryer according to claim 1, further comprising:

a heater to heat the air supplied to the first drying tub and the second drying tub.

6. The clothes dryer according to claim 1, further comprising:

a blowing fan to blow air to the first drying tub and the second drying tub.

7. The clothes dryer according to claim 1, further comprising:

a filter to filter foreign matter from air discharged from at least one of the first drying tub and the second drying tub.

8. The clothes dryer according to claim 1, wherein the second drying tub is disposed above the first drying tub.

9. The clothes dryer according to claim 1, wherein the first drying tub comprises a first entrance provided on a front face of the first drying tub, and the entrance to the second drying tub is provided on an upper face of the second drying tub.

10. The clothes dryer according to claim 9, further comprising:

a first door configured to open and close the first entrance.

11. The clothes dryer according to claim 10, wherein the plurality of racks in the second drying tub are provided in multiple layers.

12. The clothes dryer according to claim 11, wherein the plurality of racks are configured to be unfolded upward when the door is configured such that the entrance is opened.

13. The clothes dryer according to claim 11, wherein the plurality of racks are configured to be popped up upward when the door is pushed.

14. The clothes dryer according to claim 11, wherein the plurality of racks comprises a first rack and a second rack arranged below the first rack, the door is coupled to the first rack; and the door is configured such that when the entrance is opened, the plurality of racks is unfolded upward such that a gap between a front end of the first rack and a front end of the second rack is larger than a gap between a rear end of the first rack and a rear end of the second rack.

15. A clothes dryer, comprising:

a main body;

a drying tub provided inside the main body and including an entrance provided on an upper face of the drying tub;

a door configured to be moveable from a first position in which the entrance is closed to a second position in which the entrance is opened; and a plurality of racks, provided in multiple layers, configured to be provided inside the drying tub when the door is in the first position and to be unfolded upward when the door is moved to the second position.

16. The clothes dryer according to claim 15, wherein the door and the plurality of racks are configured to be popped up upward when the door is pushed.

17. The clothes dryer according to claim 15, further comprising:

a plurality of link members to connect the plurality of racks to each other; and an elastic member to elastically support the plurality of link members so as to pop up the plurality of racks upward when the door is moved to the second position.

18. The clothes dryer according to claim 15, wherein the plurality of racks comprises a first rack and a second rack arranged below the first rack, and when the door is moved to the second position, the plurality of racks is unfolded upward such that a gap between a front end of the first rack and a front end of the second rack is larger than a gap between a rear end of the first rack and a rear end of the second rack.

19. The clothes dryer according to claim 18, further comprising:

a link member connecting the front end portion of the first rack with the rear end portion of the second rack.

20. The clothes dryer according to claim 19, wherein the second rack comprises a stopper protrusion to limit an angular range between the link member and the second rack.

21. A clothes dryer, comprising:

a main body;

a first drying tub, disposed inside the main body, configured to rotate while performing a first drying tub drying operation;

a second drying tub, disposed inside the main body, configured to remain in a fixed state while performing a second drying tub drying operation, the second drying tub having an entrance with a door configured to open and close the entrance, and having a plurality of racks which extend through the entrance when the entrance is open;

a supply duct configured to supply air into each of the first drying tub and the second drying tub when both the first drying tub drying operation and second drying tub drying operation are selected;

a first discharge duct configured to discharge humidified air from the second drying tub to the first drying tub; and a second discharge duct configured:

to guide air, discharged by the first discharge duct into the first drying tub, out of the first drying tub to an outside of the main body, and to guide air, supplied into the first drying tub from the supply duct, out of the first drying tub to the outside of the main body.

22. The clothes dryer according to claim 21, further comprising an inlet duct, connected at one end to an outlet of the supply duct and connected to an inlet of the second drying tub at another end, to guide air supplied from the supply duct into the second drying tub, wherein the inlet duct is connected at the one end to the outlet of the supply duct upstream from a point where the supply duct supplies air into the first drying tub.

23. The clothes dryer according to claim 22, further comprising a shutter configured to be selectively operated to allow or prevent a supply of air into the second drying tub based on whether only the first drying tub drying operation is selected or both the first drying tub drying operation and second drying tub drying operation are selected.

24. The clothes dryer according to claim 21, further comprising:

a blowing fan configured to blow air to the first drying tub and the second drying tub; and a heater configured to heat the air blown by the blowing fan that is to be supplied into each of the first drying tub and the second drying tub via the supply duct when both the first drying tub drying operation and second drying tub drying operation are selected.

* * * * *